US008838427B2

(12) United States Patent
Segal et al.

(10) Patent No.: US 8,838,427 B2
(45) Date of Patent: Sep. 16, 2014

(54) METHOD FOR DETERMINING THE CLOSURE PRESSURE OF A HYDRAULIC FRACTURE

(75) Inventors: Arkadiy Yurievich Segal, Moscow (RU); Kurt Kreso Butula, Zagreb (HR); Jerome Maniere, Pessac (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 643 days.

(21) Appl. No.: 13/129,834

(22) PCT Filed: Nov. 27, 2009

(86) PCT No.: PCT/RU2009/000653

§ 371 (c)(1), (2), (4) Date: Jul. 25, 2011

(87) PCT Pub. No.: WO2010/064959

PCT Pub. Date: Jun. 10, 2010

(65) Prior Publication Data

US 2011/0276318 A1 Nov. 10, 2011

(30) Foreign Application Priority Data

Dec. 5, 2008 (RU) ..... 2008147999

(51) Int. Cl.

| | |
|---|---|
| ***G06F 17/10*** | (2006.01) |
| ***E21B 43/26*** | (2006.01) |
| ***E21B 43/20*** | (2006.01) |
| *E21B 43/267* | (2006.01) |

(52) U.S. Cl.

CPC ..... *E21B 43/26* (2013.01); *E21B 43/267* (2013.01); *E21B 43/20* (2013.01)

USPC ..... 703/10

(58) Field of Classification Search

CPC ..... E21B 43/20; E21B 43/267; E21B 43/263; E21B 43/26; G06F 17/5009

USPC ..... 703/10

See application file for complete search history.

(56) References Cited

U.S. PATENT DOCUMENTS

| | | | | |
|---|---|---|---|---|
| 4,372,380 | A | 2/1983 | Smith et al. | |
| 4,802,144 | A | 1/1989 | Holzhausen et al. | |
| 5,050,674 | A | 9/1991 | Soliman et al. | |
| 5,081,613 | A | 1/1992 | Holzhausen et al. | |
| 5,170,378 | A | 12/1992 | Mellor et al. | |
| 5,206,836 | A | 4/1993 | Holzhausen et al. | |
| 5,275,041 | A | 1/1994 | Poulsen | |
| 6,705,398 | B2 | 3/2004 | Weng | |
| 2006/0122777 | A1 * | 6/2006 | Patzek et al. | 702/6 |

FOREIGN PATENT DOCUMENTS

| | | |
|---|---|---|
| RU | 2270335 C2 | 6/2005 |

OTHER PUBLICATIONS

Erol Memioglu, "Injection booster for testing" Middle East Well Evaluation Review No. 12, 1992 pp. 40-57.*

Upchurch, E. R., "Determining Fracture Closure Pressure in Soft Formations Using Postclosure Pulse Testing", SPE 56723, presented at the 1999 SPE Annual Technical Conference and Exhibition held in Houston, TX, Oct. 3-9, 1999, pp. 1-8.

* cited by examiner

*Primary Examiner* — Dwin M Craig

(57) ABSTRACT

The method relates to the field of hydraulic fracturing of subsurface formations. A mathematical simulation model of a pressure pulse propagation inside a wellbore and inside a fracture is created. Pressure pulses are sent to the wellbore, and the response of the well to the pressure pulses is registered. Then, a bottom-hole pressure corresponding to each pulse is determined. An average fracture width is derived by using the mathematical simulation model of pressure pulse propagation inside the wellbore and inside the fracture, and a ratio between the simulated average fracture width and the determined bottom-hole pressure is determined. The said ratio is extrapolated to a zero-width point, and the closure pressure is determined as the bottom-hole pressure corresponding to the zero width.

2 Claims, No Drawings

METHOD FOR DETERMINING THE CLOSURE PRESSURE OF A HYDRAULIC FRACTURE

FIELD

The invention relates to the field of hydraulic fracturing of subsurface formations and, in particular, to methods for determination of the hydraulic fracture closure pressure.

BACKGROUND

In the oil and gas industry, the hydraulic fracturing is the main method used for increasing the productive capacity of a well through creation or expansion of channels from a wellbore to oil-bearing formations. This operation is generally accomplished by feeding hydraulically a fracturing fluid into a well which intersects subsurface rock. The fluid is injected into the rock beds at a high pressure sufficient to make a tension crack in the rock and to increase, as a result, the area of contact with the reservoir. Cracks occur in the rock or in the rock beds, and they form or expand one or more fractures, which usually results in increased production of oil from oil-bearing formations. A similar procedure is used for stimulating the production of gas from gas fields or the production of steam from geothermal sources. Ceramic or sand particles (proppant) are also injected into the well so that the well could be kept opened after the pressure has been relieved and the rock beds have closed. In situations where hydraulic fracturing is applied to carbonate-type rock, different acid systems are used for etching the outside surfaces of the fracture and for keeping them opened.

The post-fracturing productive capacity of the well depends on many factors, including the reservoir penetrability, porosity and pressure, as well as the properties of the fluid injected, etc. One of the most important factors is the fracture closure pressure. The fracture closure pressure is defined as the fluid pressure at which the existing fracture closes as a whole. The closure pressure forms the basis of the entire fracture analysis and is also used for proppant selection.

Various tests have been developed for determination of the fracture closure pressure, e.g. the injection/withdrawal test which determines the closure from different pressure decay rates (before and after the closure) during the fluid withdrawal to the surface at a constant flow rate; also, the pressure decay analysis which is based on identification of specimens and on calculations of the special time function (Nolte's G-plot); also, the post-closure analysis which is based on back calculations of the time to closure, calculated from the reservoir performance in case of a linear or transient inflow to the fracture. The introduction to these methods can be found in 'Fracture Evaluation Using Pressure Diagnostics', Chapter 9 of 'Reservoir Stimulation' published by John Wiley & Sons Ltd, 2000. This test is not commonly used under field conditions due to the inconvenience of installing a withdrawal pipeline maintaining a constant withdrawal rate.

DETAILED DESCRIPTION

The technical result achieved with the implementation of the invention consists in the development of a method which allows the fracture closure pressure to be determined before the fracture closes, based on the evaluation of the average fracture width.

The said technical result is achieved due to the fact that a method for determination of the hydraulic fracture closure pressure comprises the following steps: a mathematical simulation model of a pressure pulse propagation inside a wellbore and inside a fracture is created; pressure pulses are sent to the wellbore; the response of the wellbore to the pressure pulses is recorded; a bottom-hole pressure corresponding to each pulse is determined; an average fracture width is derived by comparing the results of the mathematical simulation of pressure pulse propagation inside the wellbore and inside the fracture with actual data; a ratio between the simulated average fracture width and the determined bottom-hole pressure is determined; the said ratio is extrapolated to a zero-width point; and the closure pressure is determined as the bottom-hole pressure corresponding to the zero width. Pressure pulses can be generated either by special units added to standard fracturing equipment, or by the standard equipment, e.g. by one of the fracturing pumps. In particular, a natural strong pressure pulse occurs during a pump shutdown.

The method for determination of a hydraulic fracture closure pressure through sending pressure pulses to the wellbore to be treated is implemented as follows. A mathematical simulation model of a pressure pulse propagation inside a wellbore and inside a fracture is created. Then, data on the well completion and the fracturing fluid properties are obtained. Using the simulation model of pressure pulse propagation inside the wellbore and inside the fracture, as well as using the input data on the well completion and the fracturing fluid properties, simulation is performed to determine a "sensitive width range" (sensitive to the fracture width variations) in which the response of the well to a pressure pulse is the most sensitive (usually, this range is equal to 0-2 mm). Then, the net pressure corresponding to the upper limit of the sensitive width range is determined (by using simulation, e.g. by using commercial fracturing simulators), and the well head pressure corresponding to the said net pressure is evaluated. Pressure pulses are sent to the well by using surface equipment (e.g. by using one of the pumps), and the response of the well to the pressure pulses is recorded by using pressure transmitters. The fracture width and other parameters of the mathematical model are adjusted to achieve the best consistency between the simulated data and the experimental data. Then, a bottom-hole pressure is derived from the pressure data, and the relationship (e.g. the best linear approximation) between the simulated average fracture width and the derived bottom-hole pressure is determined. Then, the said relationship is extrapolated to a zero-width point, and the closure pressure is determined as the bottom-hole pressure corresponding to the zero width.

The invention claimed is:

1. A method for determination of a hydraulic fracture closure pressure comprising the steps of:

creating a mathematical simulation model of a pressure pulse propagation inside a wellbore and inside the fracture, sending pressure pulses to the wellbore;

registering the wellbore response to the pressure pulses, determining a bottom-hole pressure corresponding to each pressure pulse;

deriving an average fracture width by comparing the results of the mathematical simulation of pressure pulse propagation inside the wellbore and the fracture with actual data;

determining the ratio between the simulated average fracture width and the determined bottom-hole pressure;

extrapolating the said ratio to a zero-width point, and determining the closure pressure as the bottom-hole pressure corresponding to the zero width.

2. The method of claim 1, wherein pressure pulses are generated by standard equipment, e.g. by one of the fracturing pumps.

* * * * *